US006557523B1

(12) United States Patent
Bos et al.

(10) Patent No.: US 6,557,523 B1
(45) Date of Patent: May 6, 2003

(54) ELECTRONIC THROTTLE BODY WITH INSERT MOLDED ACTUATOR MOTOR

(75) Inventors: Edward Albert Bos, Ann Arbor, MI (US); James Richard Rauch, Grass Lake, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/610,560

(22) Filed: Jul. 5, 2000

(51) Int. Cl.[7] ..... F02D 9/08
(52) U.S. Cl. ..... 123/337; 123/399
(58) Field of Search ..... 123/337, 361, 123/399; 29/890.12, 890.126; 251/305

(56) References Cited

U.S. PATENT DOCUMENTS 4,212,272 A * 7/1980 Hawk ..... 123/339
4,237,742 A 12/1980 Barthruff
5,035,218 A 7/1991 Takeuchi
5,040,508 A 8/1991 Watanabe
5,092,296 A 3/1992 Gunter et al.
5,201,291 A 4/1993 Katoh et al.
5,301,646 A 4/1994 Doi et al.
5,452,697 A 9/1995 Sasaki et al.
5,490,487 A 2/1996 Kato et al.
5,562,081 A 10/1996 Hitchcock
5,664,542 A 9/1997 Kanazawa et al.
5,718,202 A 2/1998 Bentz et al.
5,868,114 A 2/1999 Kamimura et al.
5,934,250 A 8/1999 Fujikawa et al.
5,979,405 A * 11/1999 Sato et al. ..... 123/399
6,000,377 A * 12/1999 Sato et al. ..... 123/337

* cited by examiner

*Primary Examiner*—Willis R. Wolfe
*Assistant Examiner*—Mahmoud Gimie

(57) ABSTRACT

An electronic throttle control system with a plastic composite housing member and injection molded motor assembly. The motor assembly is preassembled with a gear shaft member to a metal mounting plate which in turn is injection molded into the composite housing member. A portion of the motor is secured to the electronic throttle control housing during the injection molding process. The distance between the gear shaft member and motor remains constant.

5 Claims, 1 Drawing Sheet

ELECTRONIC THROTTLE BODY WITH INSERT MOLDED ACTUATOR MOTOR

TECHNICAL FIELD

This invention relates to electronic throttle control mechanisms for internal combustion engines.

BACKGROUND

Valve assemblies for engines and related systems typically utilize rotatable valve members in fluid flow passageways to assist in regulating fluid flow through them. For example, throttle valve members are positioned in air induction passageways for internal combustion engines. The valve assemblies are controlled either mechanically or electronically and utilize a mechanism which directly operates the valve member.

For consideration such as weight, cost, and ease of manufacturing, it is preferred to have the body, cover, and some of the component members or mechanisms made from plastic materials, such as plastic composite materials. However, these materials often can expand or contract in the temperature range extremes typically experienced in vehicle engine environments. Moreover, certain operational components, such as gear members and rotatable shaft members, should be accurately positioned at all times for optimum operations. Also, it is preferable for the motors for electronic throttle control systems to not be enclosed in composite housings due to the need to dissipate heat generated in the use of the systems.

It would be desirable to have an electronic valve control system with a plastic composite housing and cover member and which accurately maintains the operating components in position at all times. It also would be desirable to have an electronic valve control system with an injection molded housing which incorporates the motor in the molding process and still allows sufficient dissipation of generated heat.

SUMMARY OF THE INVENTION

It is an object of the present invention to provide an improved electronic valve control system which utilizes molded plastic composite materials and accurately maintains the position of operating components. It is a further object of the present invention to provide an improved electronic throttle control assembly in which the motor is injection molded as part of the housing.

In accordance with the present invention, a metal motor mounting plate is provided which is insert injection molded into the plastic composite material forming the housing. A gear shaft is mounted in the metal mounting plate so that it will be accurately positioned for use with the operational mechanism of the electronic throttle control system. The motor is attached to the mounting plate prior to the injection molding procedure, and the mold and injection molded materials only covers a portion of the motor. Shutoff areas in the mold prevent the injected plastic material from covering certain areas of the motor and gear shaft.

Other features and advantages of the present invention will become apparent from the following description of the invention, particularly when viewed in accordance with the accompanying drawings and appended claims.

DESCRIPTION OF THE PREFERRED EMBODIMENT(S)

Figure 1:
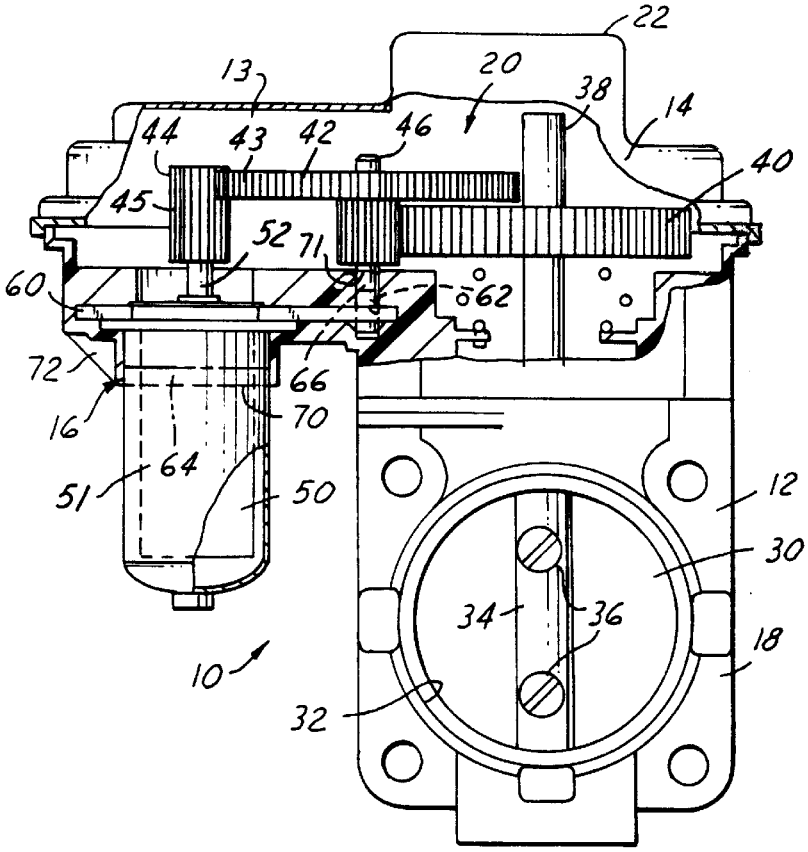
FIG. 1 illustrates an electronic throttle control assembly in accordance with the present invention.
Figure 2:
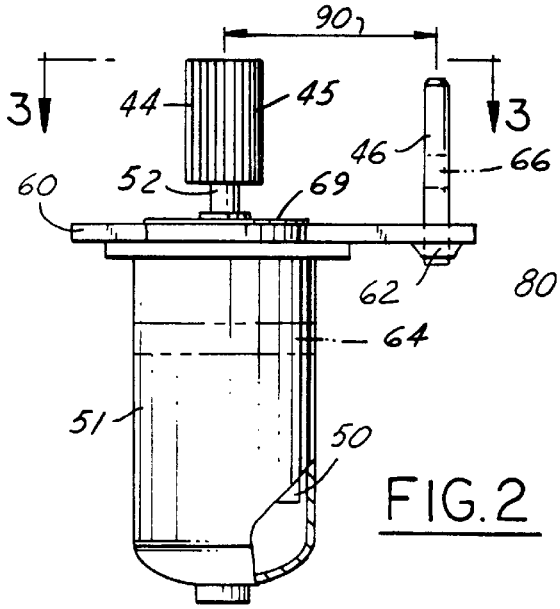
FIG. 2 illustrates the cover member of the mounting plate with a gear shaft and motor attached thereto in accordance with the present invention.
Figure 3:
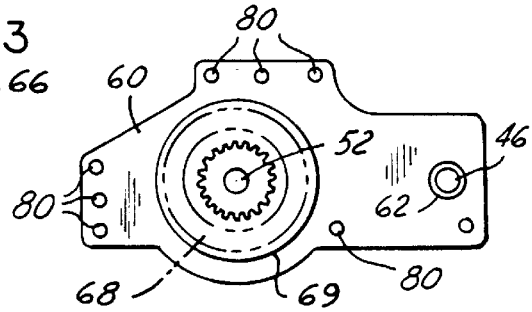
FIG. 3 is an elevational view of the metal mounting plate and attached components as shown in FIG. 2.

FIGS. 1–3 illustrate a preferred embodiment of an electronic throttle control assembly in accordance with the present invention. The electronic throttle control assembly is generally indicated by the reference numeral 10 in FIG. 1.

The electronic throttle control assembly 10 includes a housing or body member 12 and a cover member 14. A cavity 13 is formed between the cover member and housing. The housing 12 includes a motor section 16, throttle valve section 18, and a gear train mechanism 20. The cover member includes a throttle position sensor (TPS) 22, together with related electronics, which reads or senses the position of the throttle valve and transmits it to the electronic control unit (ECU) of the vehicle. The cover member 14 also contains an electronic connector member (not shown) which connects the TPS to the electronic control unit and also supplies power to the electronic throttle control assembly.

A throttle valve 30 is positioned in an air flow passageway 32 in the body or housing member 12. The throttle valve member 30 is connected to a throttle shaft member 34 by a plurality of fasteners 36. One end 38 of the throttle shaft member protrudes through the body member and into the cavity formed between the cover member and the housing.

The gear train mechanism 20 is positioned in the cavity 13 between the housing or body member and inside the cover member. Gear member 40, which is part of the gear train mechanism 20, is attached to the throttle shaft member 34. The gear train mechanism 20 also includes an idler gear member 42 and a spur gear member 44. The intermediate or idler gear member 42 is attached to an idler shaft member 46. The spur gear member is attached to the shaft 52 of the motor.

A motor 50 which has an outer housing or casing 51 and is secured to the housing member 12 and used to operate the gear train mechanism which in turn rotates the throttle valve shaft member 38 and positions the throttle valve member 30 at a desired position in the air flow passageway 32. The motor 50 is connected to the shaft 52 on which the spur gear 44 is secured. In this manner, when the motor 50 is activated by the electronic control unit due to signals received from the operator of the vehicle, the position of the throttle valve member 30 in the air passageway is adjusted in order to allow the appropriate amount of air to enter into the engine and meet the requested demand. The position of the throttle valve member in the air flow passageway is sensed by the TPS and relayed or fed back to the ECU to confirm or adjust the desired throttle valve setting. The throttle valve thus regulates the air flow to the internal combustion engine and in turn the speed of the engine and velocity of the vehicle.

Spur gear 44 has a plurality of teeth 45 which mesh with the teeth 43 in adjacent idler gear 42 in the gear train mechanism 20 as mentioned above. The gear members 40, 42 and 44 are preferably made from a plastic material, such as nylon, although they can be made of any other comparable material, or metal, which has equivalent durability and function. Also, the gear member 40 is preferably molded onto the end 38 of the throttle shaft member 34 in order to be firmly and permanently affixed to the shaft member.

The motor 50 is typically a DC motor and typically has a casing or outer shell member 51 made from an aluminum or metal material. Since typical automotive composite materials have difficulty dissipating the amount of heat generated by such motors, the motor preferably should not be enclosed in a composite housing. A metal motor mounting plate 60 is insert molded into the housing or body member 12. The motor 50 via the motor casing 51 is attached to the mounting plate 60. Also, the idler gear shaft member 46 is press fit into opening 62 in the mounting plate 60.

With the present invention, the motor 50, mounting plate 60, and idler shaft member 46 are preassembled. The motor casing member 51 is fastened, welded or otherwise securely attached to the mounting plate 60. The idler shaft member 46 is press fit into opening 62 in the mounting plate. The assembly is then insert molded into the plastic composite material forming the electronic throttle control housing 12.

During the insert molding process, the motor 50 (with cover or casing 51) is placed in an injection molding tool or die, such that when the mold halves are closed, certain areas around the motor and gear shaft are filled with composite material. Shutoff areas are utilized in the molding process to prevent the composite material from entering the motor gear 44 and motor electrical terminal area (not shown). These are shutoff zones or areas 64, 66, and 68 as shown in the drawings. As to shutoff area 64, the motor housing is positioned in a tight tolerance fit into a cavity in the mold which prevents plastic from covering the rest of the motor. On shutoff area 66, the shaft 46 is similarly positioned in a tight tolerance fit into another cavity in the mold which prevents plastic from covering the entire shaft. Finally, as to shutoff area 68, the mold makes direct contact with the surface 69 of the motor and prevents plastic from filling the area around the gear 44. In this manner, the mold around the casing 51 is limited to the portion 70 shown in FIG. 1, and the mold around gear shaft 46 is limited to the portion 71 also shown in FIG. 1. This provides sufficient plastic material in order to firmly hold the motor 50, gear shaft 46, and mounting plate 60 in the housing 12, but does not completely enclose the motor which would create heat dissipation difficulties. The plastic also does not completely cover all of the length of the gear shaft which allows the idler gear 42 to be mounted thereon and freely rotate.

A plurality of support rib members 72, only one of which is shown, are utilized to add additional strength and reinforcement to the housing member and connection to the motor and motor casing.

The mounting plate 60 is preferably made from a metal material, such as steel, which has sufficient strength and durability for its intended use. Also, as shown in FIG. 3, the mounting plate 60 is formed with a plurality of holes or openings 80 at various portions thereof. The openings 80 are filled with plastic material during the molding process and help retain and secure the motor to the body member 12.

With the idler shaft member 46 assembled as part of the motor assembly, the center-to-center distance 90 between the idle shaft member 46 and motor shaft member 52 remains fixed and constant throughout the life of the electronic throttle control mechanism. This is an advantage over other composite electronic throttle control housing designs which may have the idler shaft member molded into or press fit directly into the composite housing. In such designs, the center-to-center distance can change due to environmental conditions, such as humidity and temperature, that the electronic throttle control assemblies are exposed to during normal operation of vehicles.

While the invention has been described in connection with one or more embodiments, it is to be understood that the specific mechanisms and techniques which have been described are merely illustrative of the principles of the invention. Numerous modifications may be made to the methods and apparatus described without departing from the spirit and scope of the invention as defined by the appended claims.

What is claimed is:

1. An electronic throttle control assembly comprising:

a housing made from a plastic composite material;

a cover member positioned on said housing and forming a cavity therebetween;

an air passageway in said housing;

a throttle shaft rotatably positioned in said housing with one end extending through said air passageway and the other end extending into said cavity between said cover member and said housing;

a mounting plate molded into said housing;

a motor attached to said mounting plate before said mounting plate is molded into said housing, said motor being partially covered by said plastic composite material; and a gear shaft attached to said mounting plate and extending into said cavity.

2. The electronic throttle control assembly as recited in claim 1 further comprising a gear train mechanism comprising a first gear member attached to said motor, a second gear member positioned on said gear shaft, and a third gear member attached to said other and of said throttle shaft.

3. The electronic throttle control assembly as recited in claim 1 wherein said gear shaft is press fit into an opening in said mounting plate.

4. A method of manufacturing an electronic throttle control mechanism, said mechanism having a housing, a cover, a motor, gear train mechanism, and throttle valve member, said method comprising the steps of:

forming an assembly of a motor, metal mounting plate, and gear shaft for the gear train mechanism, positioning said assembly into a mold;

injecting plastic material into said mold to form said housing, said housing encapsulating said metal mounting plate, a portion of said gear shaft and a portion of said motor;

positioning said gear train mechanism on said housing; and positioning said cover on said housing enclosing said gear train mechanism.

5. The method as recited in claim 4 further comprising the steps of positioning a throttle shaft member in said housing and attaching said gear train mechanism to said throttle shaft member.

* * * * *